US005678805A

United States Patent [19]

Moser et al.

[11] Patent Number: 5,678,805

[45] Date of Patent: Oct. 21, 1997

[54] METHOD AND APPARATUS FOR RETRIEVING LOST GOLF BALLS INCLUDING GOLF BALL PICKER AND POWER DRIVE DEVICE FOR MOVING THE PICKER

[76] Inventors: Harold E. Moser; Howard G. Moser, both of P.O. Box 559, North Webster, Ind. 46555

[21] Appl. No.: 338,021

[22] Filed: Nov. 10, 1994

[51] Int. Cl.[6] ..... B66D 1/26

[52] U.S. Cl. ..... 254/279; 254/283; 254/317; 242/388.8; 414/440

[58] Field of Search ..... 254/279, 284, 254/283, 315, 317, 321, 388; 242/422.5, 388.7, 388.8; 212/322, 171; 414/434, 442, 437, 440; 56/328.1

[56] References Cited

U.S. PATENT DOCUMENTS

| | | | |
|---|---|---|---|
| 813,211 | 2/1906 | Jacobs | 242/388.8 X |
| 1,123,602 | 1/1915 | Sessions | 242/388.8 X |
| 2,749,056 | 6/1956 | Jenkins | 242/422.5 |
| 3,003,585 | 7/1961 | Andersson | 254/317 X |
| 4,158,418 | 6/1979 | Hayashi | 56/328.1 X |
| 4,984,836 | 1/1991 | Redding | 414/440 X |
| 4,986,141 | 1/1991 | Meurer | 74/89.22 |

*Primary Examiner*—Daniel P. Stodola
*Assistant Examiner*—Emmanuel M. Marcelo
*Attorney, Agent, or Firm*—Baker & Daniels

[57] ABSTRACT

A method and apparatus for retrieving golf balls from a submerged surface includes a power drive device which is stationed along the shore of the submerged surface of a golf course water hazard and which carries a pair of spools on which flexible line is wound. The flexible line on one spool is connected directly to a golf ball retrieving mechanism, and the line from the other spool is connected around a pulley on a deadman stake on the opposite side of the submerged surface and is then connected to the golf ball retrieving device. Accordingly, the golf ball retriever is moved along the submerged surface toward and away from the opposite shores of the water hazard by alternatively driving one of the spools and permitting the other spool to unwind. The power drive device is moved incrementally along the shore surface after each sweep of the golf ball retriever so that golf balls may be retrieved from all of the submerged surface.

12 Claims, 4 Drawing Sheets

METHOD AND APPARATUS FOR RETRIEVING LOST GOLF BALLS INCLUDING GOLF BALL PICKER AND POWER DRIVE DEVICE FOR MOVING THE PICKER

This invention relates to a method and apparatus for retrieving lost golf balls.

Golf balls are routinely lost by golfers during golf course play. Many of these golf balls are lost in water hazards. Over the course of the year, thousand of golf balls are lost in water hazards at a single golf course. Most of these golf balls are virtually new, and have no significant defects. Accordingly, if these golf balls can be economically recovered, they may be used again.

Golf balls have heretofore been retrieved from water hazards or ponds on golf courses either by employing scuba divers to go into the water hazards and pick up the golf balls up off of the bottom, or by using a golf ball picking device of the same general type illustrated in U.S. Pat. No. 3,995,759. The picking device according to this patent is pulled between a pair of winches mounted on each of a pair of all terrain vehicles which are stationed on opposite sides of the water hazard. The recovery of golf balls by scuba divers is not generally economical, and the various chemicals used on golf courses to insure quality turf drain into the water hazards, making recovering of golf balls by divers hazardous. Recovery of golf balls by the picking device according to the above identified patent is also difficult, since the picking device may encounter snags and obstructions in the water hazards that are not visible from the shore. Accordingly, the all terrain vehicles upon which the winches are mounted may be tossed into the air or may be pulled into the water hazard. Furthermore, such all terrain vehicles with winches are extremely expensive, and two operators are required to operate the all terrain vehicles.

According to the present invention, a power drive device is placed at one station on the shore of the water hazard and a pulley mounted on a deadman stake is placed at another station on the opposite shore of the water hazard. The power drive device includes a pair of spools upon which a flexible line is wound. The line from one of the spools is threaded through the pulley on the deadman device and attached to a golf ball picker of the same general type disclosed in the above identified U.S. patent. The line from the other spool is also attached to the golf ball picker. A hydraulic motor drives a common shaft on which both of the spools are mounted. A shift lever is provided to alternately connect one of the spools to the hydraulic motor to wind line onto the spool, while the other spool is permitted to freewheel to permit line to unwind from that spool. The shift lever shifts the driving connection between the spools, so that the golf ball picker may be moved between the shore adjacent the power drive device and the shore adjacent the deadman stake. The power drive device is moveable so that the power drive device may be moved incrementally after each sweep of the ball picker across the bottom of the water hazard. Accordingly, the entire water hazard may be swept for golf balls which are removed from the picker manually. Accordingly, golf balls may be retrieved from the water hazard using only a single operator. Furthermore, the hydraulic motor may be overridden by forces applied to the spool by opening a relief valve connected around the hydraulic motor if the golf ball picker encounters an object and stops suddenly.

These and other advantages of the present invention will become apparent from the following specification, with reference to the accompanying drawings, in which.

Figure 1:
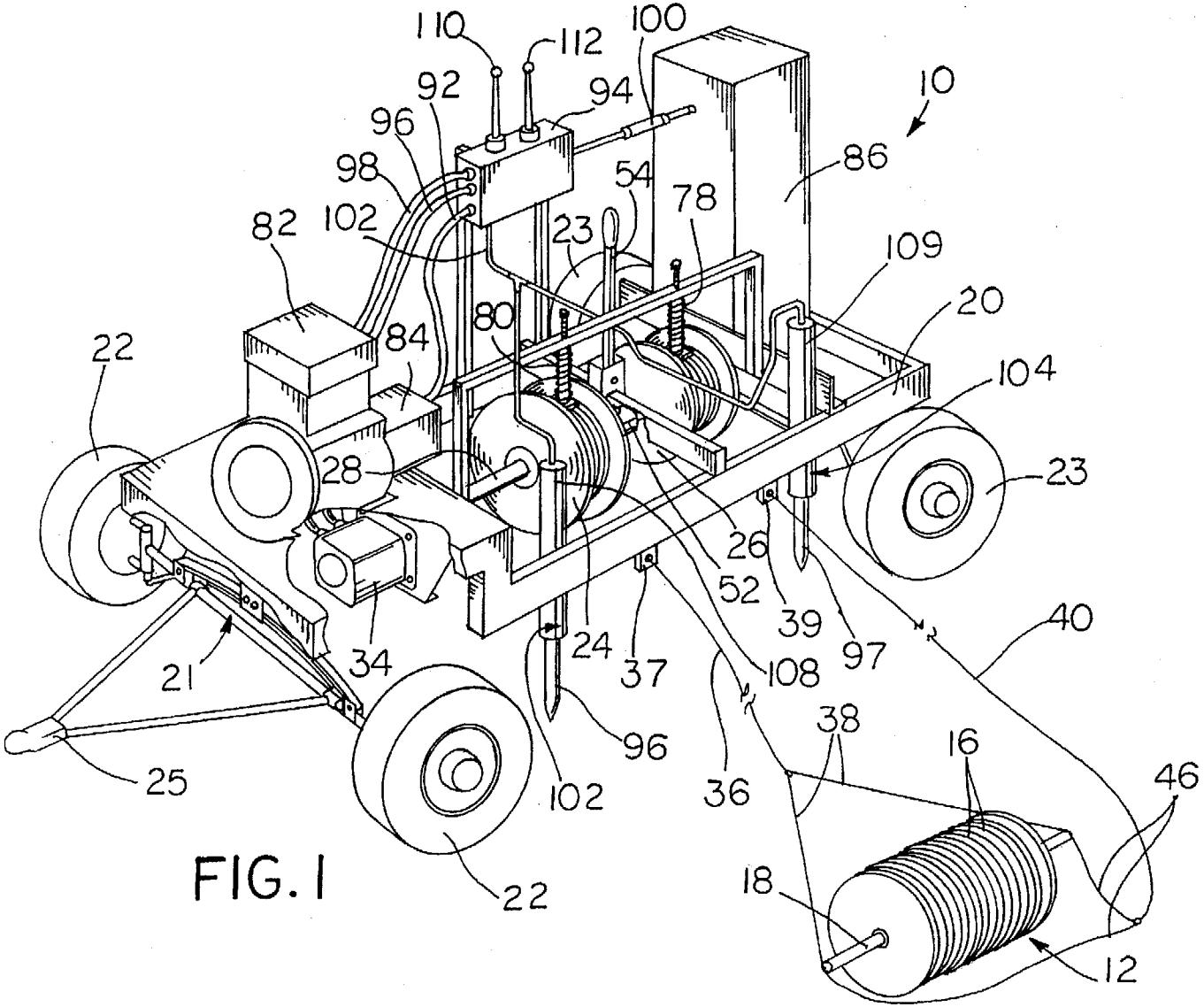
FIG. 1 is a perspective view of a golf ball picker and a power drive device for operating the picker made according to the teaching of the present invention.

Referring now to the drawings, the golf ball retrieval system according to the present invention includes a power drive device generally indicated by the numeral 10 which moves a golf ball picker generally indicated by the numeral 12 across the bed of a golf course water hazard 14. The picker 12 is described in the above identified U.S. Pat. No. 3,995,759 and includes substantially parallel, spaced apart discs 16 that are spaced from each other a distance slightly less than the diameter of a golf ball. Accordingly, when the picker 12 is rolled across a surface upon which golf balls are lying, golf balls become wedged between the discs 16, and may later be manually removed and collected. The discs 16 are mounted on an axle 18.

The power drive device 10 includes a frame 20 supported by front wheels 22 and rear wheels 23 so that the power drive device may be moved around the water hazard 14. Front wheels 22 are connected to the frame 20 by a conventional suspension 21 that permits wheels 22 to move relative to each other in a vertical direction when the device 10 is moved over uneven ground. Wheels 22 are steerable through tongue 25, which permits the device 10 to be pulled. A pair of spools 24, 26 are mounted on the frame 20. The spool 24 is mounted for rotation relative to a shaft 28 by bearings 30, and bearings 32 support the spool 26 for rotation about the same shaft 28. A conventional hydraulic motor 34 is connected to the shaft 28 through a flexible coupling (not shown) so that the fluid motor 34 rotates the shaft 28. A flexible line 36, such as a rope or cable, is wound on the spool 24 and is connected to opposite ends of the axle 18 of the picker 12 by a "Y" connection 38. A similar flexible line 40 is wound on the spool 26 and is threaded through a pulley illustrated schematically at 42 that is attached to a deadman's stake 44 which is placed at a station on the shore of the water hazard 14 separate from the station on the shore at which the motor drive device 10 is located. The flexible line 40 is then attached to the opposite ends of the axle 18 by a "Y" connector 46. Flexible lines 36 and 40 extend through guides 37 and 39 mounted on frame 20.

Figure 3:
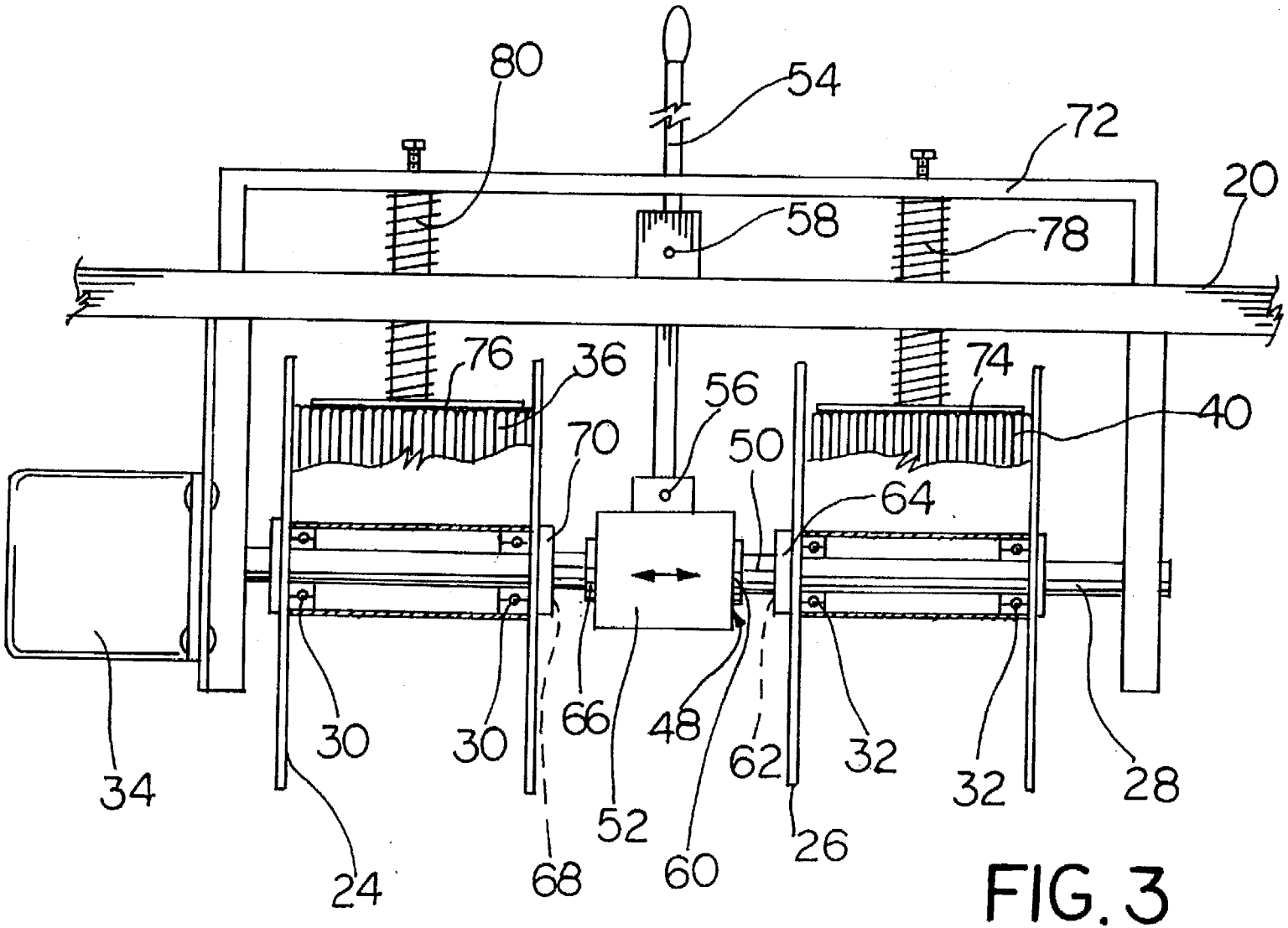
FIG. 3 is a fragmentary, size elevation view of the spools and hydraulic motor portion of the power drive device illustrated in FIG. 1.
Figure 4:
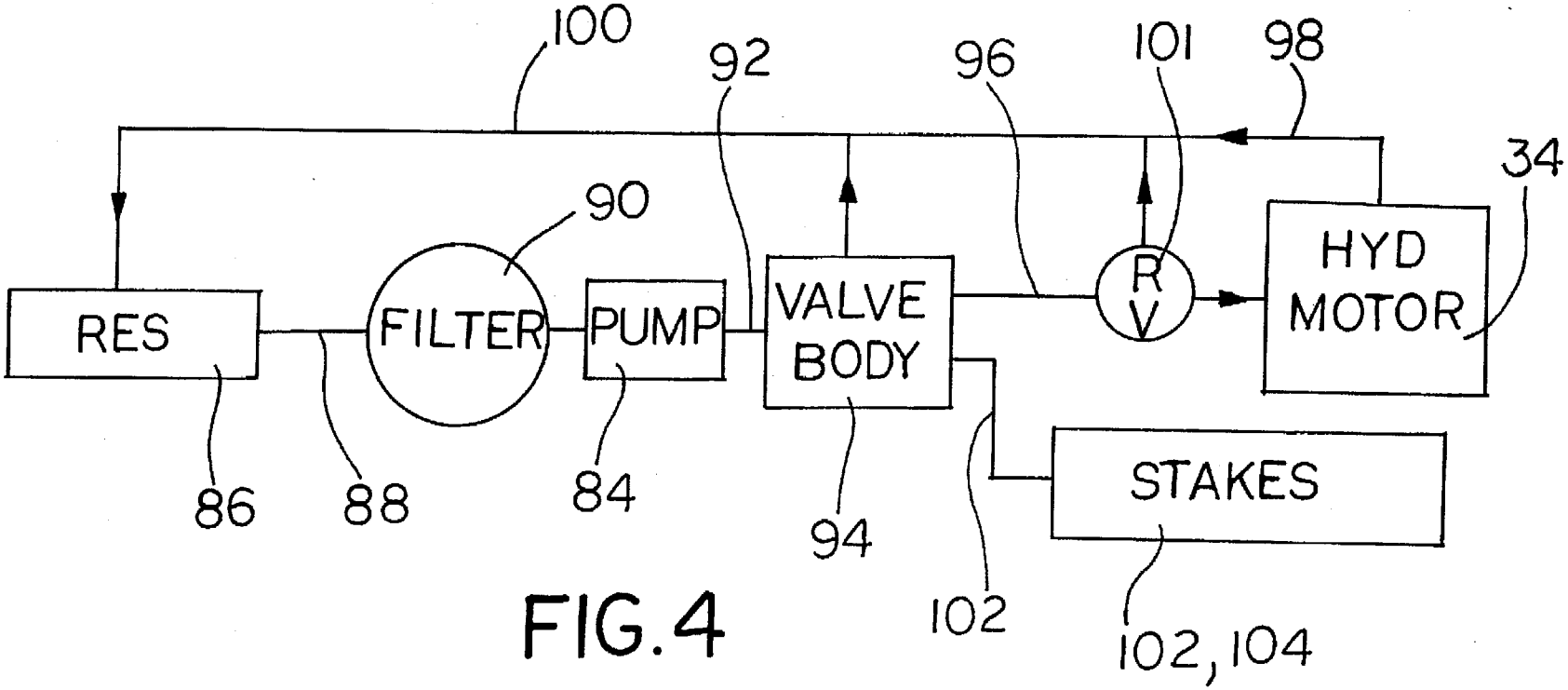
FIG. 4 is a schematic illustration of the hydraulic circuit used in the power drive device illustrated in FIG. 1.

A sliding gear 48 is keyed for axial movement along the shaft 28 in a keyway slot 50 formed in the shaft 28. The gear 48 is rotatably mounted in a bracket 52 which is connected to an operator actuated shift lever 54 by a pivot 56. The shift lever 54 is also connected to the frame 20 by pivot 58. Circumferentially spaced teeth 60 which are spaced around the sliding gear 48 on the right side thereof viewing FIG. 3 and are adapted to engage female teeth 62 formed circumferentially within extension 64 which is a part of the spool 26. Similarly, circumferentially spaced teeth 66 on the opposite end of the sliding gear 48 are adapted to engage circumferentially spaced female teeth 68 formed within extension 70 which is a part of the spool 24. Accordingly, by moving the lever 54 to the left viewing FIG. 3, the gear 48 slides along the keyway 50 to engage teeth 60 with teeth 62, thereby connecting the spool 26 for rotation with the shaft 28. By moving the lever 54 to the right viewing FIG. 3, the gear 48 slides to the left along keyway 50, thus engaging the teeth 66 with the teeth 68, to thereby drivingly connect the spool 24 with the shaft 28. Frame 20 includes a subframe 72 on which a pair of tensioning pads 74, 76 are mounted. Springs 78, 80 urge their corresponding tensioning pad 78 or 80 into frictional engagement with the flexible line 36, 40 wound on the spools 24, 26.

A relatively small, single cylinder, internal combustion engine generally indicated by the numeral 82 is mounted on the frame 20 and powers a conventional hydraulic pump 84. Pump 84 draws fluid from a fluid reservoir 86 through line 88 and conventional filter 90 and delivers pressurized fluid through outlet line 92 to a double lever valve body 94. Valve body 94 is also coupled with outlet line 96 and return line 98, which are connected to hydraulic motor 34, and to return line 100, which communicates with the reservoir 86. A relief valve 101 is connected in the line 96 and opens when the pressure in line 96 increases to a predetermined pressure to open the line 96 to line 98, thereby bypassing the hydraulic motor 34. Valve body 94 is also connected to outlet line 102 which communicates the valve body 94 to each of a pair of hydraulically actuated stakes 102, 104. The stakes 102, 104 are responsive to hydraulic pressure to drive tips 96, 97 of the stakes into the ground and to maintain the tips 106, which are moveable relative to the cylinders 108, 109 in their downward position as long a fluid pressure is applied to the hydraulically driven stakes 102, 104. Upon release of hydraulic pressure, springs within the cylinders 108, 109 urge the tips 106, 107 upwardly, permitting the power drive device 10 to be moved. While the power drive device 10 is parked and operating, the hydraulic actuated stakes 102, 104 anchor the power drive device against movement relative to the ground and stabilize the device to prevent tipping and upsetting. The valve body 94 further includes a lever 110 that controls communication between the outlet of pump 84 and the stakes 102, 104 and a lever 112 which controls communication between the pump 84 and the hydraulic motor 34. When both of the levers 110, 112 are in the "off" or "closed" position, the outlet of pump 84 is returned directly to the reservoir 86.

Figure 2:
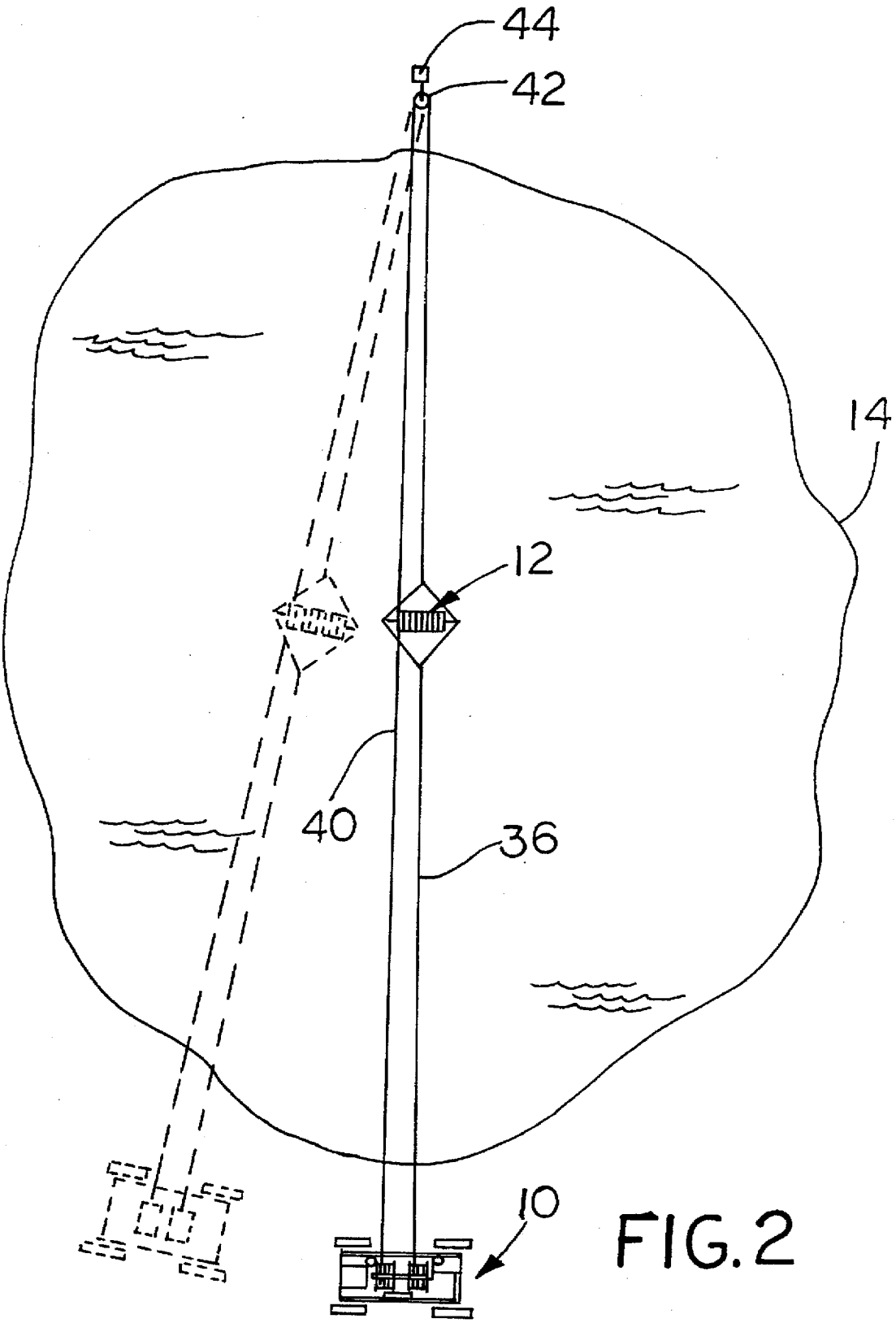
FIG. 2 is a diagrammatic illustration of the manner in which the golf ball picker and power drive device according to the present invention are used to recover golf balls from golf course water hazards.

In operation, the deadman stake 44 is installed on one station on a shore of the water hazard 14 and the power drive device 10 is moved to a location remote from the deadman's stake 44. The flexible line 40 is threaded through the pulley 42 and then connected to the golf ball picker 12 and the line 36 is also connected to the golf ball picker 12. Engine 82 is started to operate the pump 84, and lever 110 is moved to cause the hydraulically actuated stakes 102, 104 to anchor the power drive device 10. The shift lever 54 is then operated to engage the teeth 60 with the teeth 62, thereby drivingly engaging the spool 26 for rotation with the shaft 28. The lever 112 is then operated to connect the hydraulic motor 34 with the outlet of the pump 84. Accordingly, shaft 28 is turned in a direction causing flexible line 40 to wind onto the spool 26, thereby pulling the picker 12 across the bed of the water hazard toward the deadman stake 44. Of course, the picker 12 is submerged during normal operation and is only illustrated in FIG. 2 to indicate its position in the middle of the water hazard 14 midway between the power device 10 and the deadman stake 44. As the flexible line 40 is wound onto the spool 26, the spool 24, being disconnected from the shaft 22 and rotatable relative thereto due to the bearings 30, permits the flexible line 36 to unwind from spool 24 as the picker 12 is moved toward the deadman stake 44.

When the picker 12 reaches the shore of the water hazard 14 at the base of the deadman stake 44, the lever 112 is operated to cut off communication between the hydraulic motor and the pump 84, the lever 110 is operated to withdraw the hydraulically actuated states 102, 104 from their ground penetration, and the power drive device 10 is moved incrementally from the station shown in the solid lines to new station incrementally separated from the station illustrated in the solid lines. One of the many such incremental stations is illustrated by the dashed lines in FIG. 2, but it should be noted that the power drive device 10 will be located at incremental stations between the station shown in the dotted lines and the station shown in the solid lines in FIG. 2. After the power drive device is moved to its new station, hydraulic stakes 102, 104 are again actuated to anchor the power drive device 10, the shift lever 54 is moved to disengage the teeth 60 from the teeth 62 and to move the gear 48 along the keyway 50 until the teeth 66 engage the teeth 68 carried by spool 24. Accordingly, the spool 24 is coupled for rotation with the shaft 28, and the spool 26 is permitted to freewheel to unwind line 40 stored thereon. The lever 112 is then actuated to communicate the hydraulic motor 34 to the outlet of pump 84, thus causing shaft 28 to rotate in a direction winding line 36 onto the spool 24, to thereby pull the picker back across the water hazard 14 toward the power drive device 10. When the picker 12 arrives back at the shore adjacent to the power drive device 10, golf balls are manually removed from between the discs 16, the power drive device 10 is moved to the next incremental location, and the process is repeated until the entire water hazard is swept. Accordingly, golf balls can be recovered relatively efficiently from the entire bed of the water hazard 14.

As discussed above, the picker 12 is submerged as it travels across the bed of the water hazard 14. Other objects often rest on the bed of the water hazard 14, including some relatively large objects. Occasionally, the picker 12 may strike some of these large objects, abruptly stopping the picker 12. When this occurs, flexible line which is unwinding from the spool 24, 26 which is disconnected from the shaft 28 and freewheeling may "backlash" in which a large amount of the line unwinds from the spool and becomes tangled unless preventative measures are taken. Accordingly, tensioners 78, 80 apply light pressure to the line wound on the spools 24, 26 thereby preventing rapid unwinding of the cord during such "backlash" situations. It should also be noted that when the picker 12 strikes objects or reaches the shore and can no longer move that hydraulic motor 34 may apply substantial forces to the spool 24 or 26 which is drivingly connected to the hydraulic motor 34. When this occurs, pressure rapdily builds in line 96, causing relief valve 101 to open, thus bypassing fluid pressure around hydraulic motor 34, thus limiting the torque applied to shaft 28 to a predetermined maximum torque. Accordingly, damage to the power drive device 10 is prevented.

We claim:

1. Power drive device for moving a golf ball picker over a surface on which golf balls are lying, said power drive device including a frame, a pair of spools carried by said frame for winding and unwinding a flexible line, said flexible line being wound on each of said spools and extending from each spool to said golf ball picker, and drive means for driving one of said spools in a direction winding said line on said one spool while permitting the line on the other spool to unwind to thereby move said golf ball picker in one direction, said drive means being switchable to permit the line on said one spool to unwind while driving the other spool in a direction winding said line on the other spool to thereby move said golf ball picker in the opposite direction, said spools being mounted for rotation on a common shaft, said drive means including shiftable means for connecting and disconnecting said spools for rotation with said shaft, said shiftable means being shiftable from a first position for connecting one of said spools for rotation with said shaft while permitting the other spool to rotate relative to said shaft to a second position connecting the other spool for rotation with said shaft while permitting said one spool to rotate relative to said shaft, a hydraulic motor mounted on said frame for rotating said shaft, said hydraulic motor providing a fluid coupling with said shaft, said fluid coupling being overridden by torques in excess of a predetermined amount applied to said shaft to thereupon permit rotation of the shaft relative to the hydraulic motor, a pump mounted on said frame for supplying pressurized fluid to said hydraulic motor, a reservoir mounted on said frame for receiving fluid from said hydraulic motor and supplying hydraulic fluid to said pump, and valve means mounted on said frame for controlling communication between said pump, said reservoir, and said hydraulic motor, said frame including means for supporting said frame for movement relative to said surface, and hydraulically actuated stakes for anchoring said frame relative to said surface, said valve means controlling communication of hydraulic fluid to said stakes for operating the latter.

2. Method of recovering lost golf balls from the bed of a body of water comprising the steps of providing a power drive device having a pair of spools each having a flexible line wound thereon, placing said power drive device at a first station on the shore of said body of water, connecting the flexible line wound on one of said spools to a golf ball picker, connecting the flexible line wound on the other spool for movement relative to a deadman device secured against movement at a second station on said shore spaced from said first station and then connecting said line from the other spool to the golf ball picker, winding said flexible line on one of said spools while permitting the line on the other spool to unwind to move the golf ball picker to one of said stations, and then winding the flexible line on the other spool while permitting the one spool to unwind to thereby move the picker toward the other station, moving one of said devices to a series of incremental stations around the shore of said body of water while maintaining the other device in its station, and moving the golf ball picker between each of said incremental stations and the station of the other device by winding and unwinding said spools before moving the one device to a successive one of said incremental stations.

3. Method of recovering lost golf balls as claimed in claim 2, wherein said spools are mounted for rotation relative to a common driven rotating shaft mounted for rotation relative to said power drive device, said method including the steps of connecting one of said spools for rotation with said shaft while permitting the other spool to rotate relative to said shaft and then connecting said other spool for rotation with said shaft while permitting the other spool to rotate relative to the shaft.

4. Method of recovering lost golf balls as claimed in claim 2, wherein said power drive device carries ground anchors for securing said power drive device with said spools in each of said incremental stations, said method including the steps of actuating said ground anchors to anchor said power drive device after said power drive device is moved to any of said incremental stations.

5. Method of recovering lost golf balls as claimed in claim 2, wherein said method includes the steps of applying tension to said line as it unwinds from either of said spools.

6. In combination, a golf ball picker and a power drive device for moving a golf ball picker over a surface on which golf balls are lying, said power drive device including a frame, a pair of spools carried by said frame for winding and unwinding a flexible line, each of said spools being mounted for rotation on a common shaft, said flexible line being wound on each of said spools and extending from each spool to said golf ball picker, and shiftable drive means for connecting and disconnecting said spools for rotation with said shaft, said shiftable means being shiftable from a first position for connecting one of said spools for rotation with said shaft while permitting the other spool to rotate relative to said shaft for driving one of said spools in a direction winding said line on said one spool while disconnecting the other spool from rotation with said shaft to permit the flexible line on the other spool to unwind to thereby move said golf ball picker in one direction, said shiftable drive means being shiftable to a second position connecting the other spool for rotation with said shaft while permitting said one spool to rotate relative to said shaft, thereby permitting the line on said one spool to unwind to thereby move said golf ball picker in the opposite direction.

7. The combination as claimed in claim 6, wherein said shiftable drive means includes a hydraulic motor mounted on said frame for rotating said shaft, said hydraulic motor providing a fluid coupling with said shaft, said fluid coupling being overridden by torques in excess of a predetermined amount applied to said shaft to thereupon permit rotation of the shaft relative to the hydraulic motor.

8. The combination as claimed in claim 7, wherein said shiftable drive means further includes a pump mounted on said frame for supplying pressurized fluid to said hydraulic motor, a reservoir mounted on said frame for receiving fluid from said hydraulic motor and supplying hydraulic fluid to said pump, and valve means mounted on said frame for controlling communication between said pump, said reservoir, and said hydraulic motor.

9. The combination as claimed in claim 6, wherein said shiftable drive means includes a manually operated shift lever and a coupling member connected to said shift lever through a rotary connection therebetween, connecting means for joining said coupling member for rotation with said shaft while permitting said coupling member to slide along said shaft in response to movement of said shift lever, and cooperating means carried by said coupling member and,by each of said spools for alternately connecting each of said spool for rotation with said shaft as the shift lever is shifted between a first position coupling said one spool with said shaft through,said coupling member and a second position coupling said other spool with said shaft through said coupling member.

10. The combination as claimed in claim 6, wherein said shiftable drive means includes a shift lever and coupling means responsive to movement of the shift lever for coupling said one spool for rotation with the shaft and uncoupling the other spool when the shift lever is in one position and coupling the other spool for rotation with the shaft and uncoupling the one spool when the shift lever is moved into another position.

11. The combination as claimed in claim 6, wherein each of said spools are mounted on said shaft by bearings permitting relative rotation between the spools and the shaft.

12. The combination as claimed in claim 6, wherein each of said spools is provided with a tensioner to restrain unwinding of line from each spool.

* * * * *